United States Patent [19]

Ellis

[11] Patent Number: 5,020,420

[45] Date of Patent: Jun. 4, 1991

[54] VACUUM ADAPTER PLATE

[76] Inventor: Lamar Ellis, 320 W. Walnut Ave., Ontario, Calif. 91762

[21] Appl. No.: 352,743

[22] Filed: May 16, 1989

[51] Int. Cl.[5] ..... F01B 29/04; F01B 29/00; F04B 19/00

[52] U.S. Cl. ..... 92/59; 92/128; 417/238

[58] Field of Search ..... 92/59, 128; 417/569, 417/570, 571, 238, 239; 285/12

[56] References Cited

U.S. PATENT DOCUMENTS

| | | | |
|---|---|---|---|
| 1,993,664 | 3/1935 | Hirsch | 417/571 X |
| 3,834,417 | 9/1974 | Holben et al. | 285/12 X |
| 4,827,835 | 5/1989 | LaBair | 92/128 |

FOREIGN PATENT DOCUMENTS

| | | | |
|---|---|---|---|
| 0568042 | 6/1958 | Belgium | 417/571 |

*Primary Examiner*—Edward K. Look
*Assistant Examiner*—John Ryznic

[57] ABSTRACT

This invention relates to an apparatus and method for adapting an existing air pump to also include a source of vacuum emanating from the same pump. An adapter plate is secured onto the face of the pump from which an outlet protrudes and an air intake is located. The plate is provided with ports in line with the output and intake openings in the face of the pump and such openings accommodate fittings of various pre-selected sizes to provide air pressure and vacuum for use in the field of respiratory needs of a patient. The ordinarily used input of atmospheric air entering the pump through an opening in the face of the pump is thereby converted to a vacuum source in the application to a patient of an aspirator unit, and the like.

1 Claim, 1 Drawing Sheet

10
12
14
16
18
20
22
24
26
28
30
32
34
36
43
62
70
78
80
82
2
4

34
36
42
43
54
56
58
64
66
70

28
30
32
34
34a
36
37
38
40
42
43
44
46
46a
48
52
54
56
58
60
62
64
66
70
72
74
76
80
4

34
37
38
40
48
50
70

VACUUM ADAPTER PLATE

BACKGROUND OF THE INVENTION

1. Field of the Invention

The field of this invention is primarily in the providing of a calibrated flow of air pressure and of a controlled vacuum for use in, and or, oxygen separating sieve beds and respirators, and the like.

2. Description of the Prior Art

In previous methods of providing metered air pressures and vacuums to equipment used in treating respiratory ailments in patients there have been expensive and cumbersome devices that were used.

Portable devices that had to be taken to the patient while under treatment at places where such treatment was needed included cumbersome pumps, compressors, and the like, that required special handling and much expense. Regulating the pressures and vacuums also entailed much expense and cost.

Small, compact hand-held units were not available that performed the air and vacuum supplies to such patients away from stationary or very complicated portable equipment.

BACKGROUND OF THE INVENTION

In summary, this invention is a simple but direct approach to allow a small portable hand-held pump or compressor that furnishes compressed air to such items as deflated tires, or the like, to be converted simply and economically into a controlled unit that can supply both pressurized air and a vacuum toward the treatment of patients.

The Applicant has devised an apparatus and method of converting such a well-known portable compressor to perform the necessary functions such as operating an aspirator or for supplying atmospheric air to an oxygen separating sieve bed, or the like.

It is therefore an object of this invention to provide a simple adapter plate and fittings that quickly and easily converts a handheld portable compressor into a pressure creating and a vacuum forming mechanism.

It is a further object of this invention to provide such ports and fittings along with an adapter plate that regulates the flow of pressurized air and vacuum pull to the limits necessary to operate the supplied aspirators and sieve-bed oxygen separating units.

Another object of this invention is to provide an adapter method and apparatus that can be installed by a person with the simplest abilities of performance and thereby eliminate expensive services.

Yet other objects and advantages of this invention will become more apparent to those skilled in the art after considering the following detailed specification together with the accompanying drawings.

DESCRIPTION OF A PREFERRED EMBODIMENT

Figure 1:
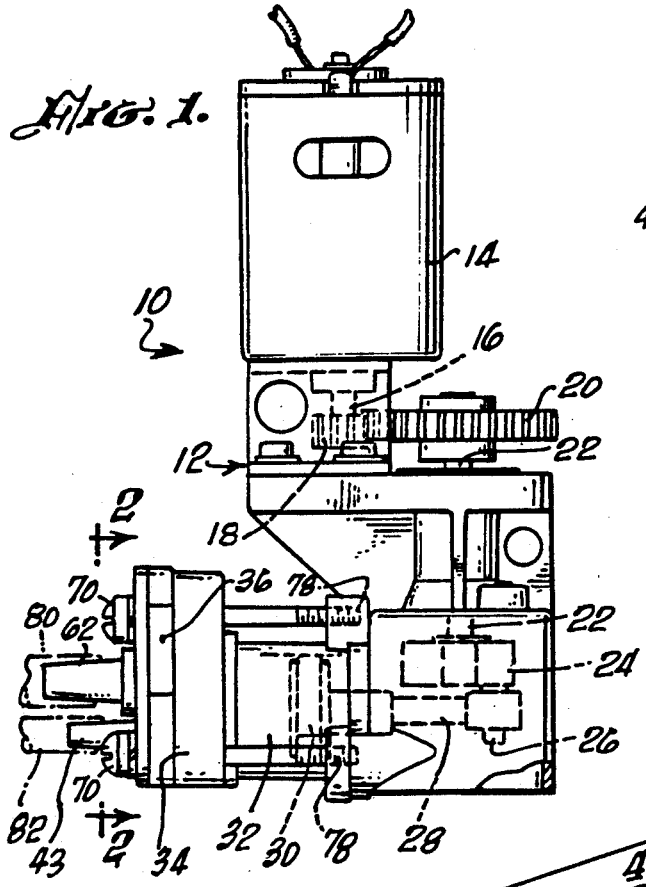
FIG. 1 is a side elevation, partly in section, of a portable pump with the adapter plate and fittings of the invention installed.
Figure 2:
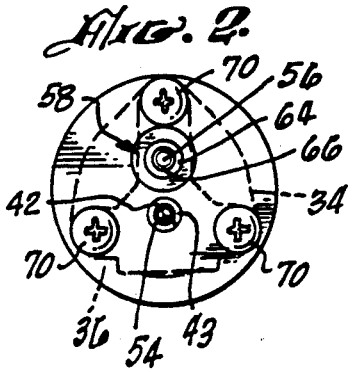
FIG. 2 is an elevational view as seen along line 2—2 of FIG. 1.

Referring to the drawings, and particularly to FIG. 1, there is shown a pump assembly 10, a pump body 12, and a motor 14. The motor can be powered by DC batteries or by other methods available to a portable unit.

The motor drive shaft 16 drives a gear 18 which in turn is in contact with a larger gear 20. A shaft 22 is then driven through larger gear 20. Affixed to shaft 22 is a counterbalanced eccentric crankarm 24 having a pivot pin 26.

Rotation of shaft 22 imparts a motion for moving a piston rod 28 along with its piston 30 back and forth within a cylinder 32. The piston is provided with a conventional seal, or the like to make the chamber within the cylinder leakproof.

Located at the end of the cylinder away from the pump body is a block member 34. A head member 36 is normally secured to the overall assembly by screws 70, but in this case, because of the addition of an adapter plate to be added to the outside face of head member 36, the screws are assembled to include such plate, to be described in more detail below.

Air that is compressed by the movement of piston 30 in its outward movement passes through an opening 37 formed through the block member 34. A plug 40, working against a spring 38, allows the air to pass one way while under pressure. The plug 40 reseats itself against a shoulder of a reduced port orifice at the end of the opening 37 closest to the piston.

Pressurized air passes through port a first 42 located in an elongated head member projection 43 formed intergrally in head member 36. A seal 44 placed in the head member 36 prevents any leakage of the compressed air during its movement out of the pump assembly. Such seal 44 is shown in an annular grooved slot in head member 36.

Figure 3:
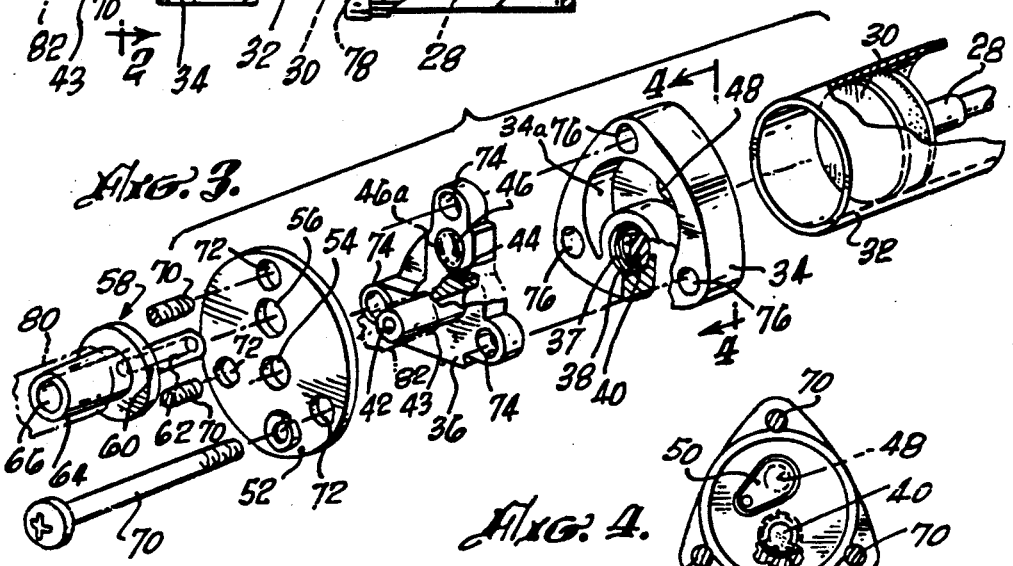
FIG. 3 is an exploded perspective of various components of the pump of FIG. 1 and the adapter plate of the invention, certain parts being broken away for clarity.
Figure 4:
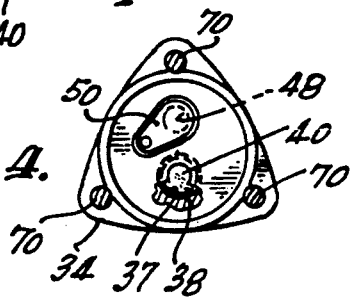
FIG. 4 is an elevational view of a block portion of the pump assembly, and showing securing screws in section, as viewed along line 4—4 of FIG. 3.

The focus should now be aimed to a second port 46 which is formed in the head member 36. This second port, now enlarged from its initial size, is formed of such a size as to accomodate a first fitting extension 62 of fitting 58, to be described later. It can be seen that the original second port shown in phantom lines **46*a* was smaller, and used only for the intake of atmospheric air into the chamber provided in block member 34. A third port 48, shown in FIGS. 3 and 4, allowed such air to be drawn into a chamber 34*a* past reed valve 50 during the movement of piston 30 to the right as seen in FIG. 1** toward the pump body.

The adapter plate, as indicated by the reference numeral 52, is provided with a first adapter plate opening 54 which allows a head member projection 43 to pass therethrough, and a second adapter opening 56, which allows extension 62 of fitting 58 to pass therethrough. The adapter plate 52, therefore, is placed against the outside face of head member 36 during assembly.

Referring to the fitting 58, it is to be understood that various configurations and sizes of adapter plate opening can be provided depending on the needs by the equipment that is being used.

Just as a typical example, but not limiting it specifically to same, a pump like the one shown can provide 12–13 liters of pressurized air per minute. A vacuum can be formed by the placement of a fitting into the second port 46 sufficient for the needs of an aspirator, and for the use in a portable oxygen sieve bed unit. Fastener accepting opening are provided at 72, 74, 76 through adapter plate 52, head member 36, and block member fasteners 34 for 70. Threaded openings 78 are located in pump body 12.

It can be seen that by merely placing an adapter plate 52 onto the head member 36 and providing fitting 58, with its predetermined openings in adapter plate 52, that it is obviously simple to attach first and second conduits 80 and 82, as shown in phantom lines, to a first fitting extension 62, and to a second filling extension 64, respectively, in order to direct air pressure and vacuum to the needs of equipment. Fitting 58 is provided with a passage 66 formed therethrough. The portability of such a simple mechanism and the simple method of constructing it makes it a very successful device. A typical pump is one like an Oriental Koshin brand.

It is to be understood that the embodiments shown are by no means attempting to limit the variations possible without leaving the scope of the invention.

I claim:

1. An adapter device for portable compressor pumps of the type that direct atmospheric air into a chamber within a pump body by means of a reciprocating piston means, and forces compressed atmospheric air out of said chamber, and in which said adapter device allows a controlled vacuum source to be utilized, which comprises:

a flat adapter plate; a fitting; a first adapter plate opening formed in said flat adapter plate of sufficient size to allow a first fitting extension of said fitting to pass therethrough; a second flat adapter plate opening formed in said flat adapter plate of sufficient size to allow an elongated projection of a head member of said pump body to pass therethrough; a plurality of fastener accepting openings formed near the outer periphery of said flat adapter plate, such openings being of sufficient size to permit fasteners to pass therethrough; said elongated projection of said head member being of sufficient extension through said second flat adapter plate opening to accomodate a second conduit; said fitting having a second fitting extension at the opposite end of said fitting than said first fitting extension; an enlarged separating flange located between said first and second fitting extensions; said second fitting extension of a sufficient size to accomodate a first conduit means.

* * * * *